US007382598B2

(12) United States Patent
Weger

(10) Patent No.: US 7,382,598 B2
(45) Date of Patent: Jun. 3, 2008

(54) MEANS FOR CONTROLLING A COIL ARRANGEMENT WITH ELECTRICALLY VARIABLE INDUCTANCE

(75) Inventor: Robert Weger, Augsburg (DE)

(73) Assignee: Mineabea Co., Ltd., Nagano-ken (JP)

( * ) Notice: Subject to any disclaimer, the term of this patent is extended or adjusted under 35 U.S.C. 154(b) by 163 days.

(21) Appl. No.: 10/885,840

(22) Filed: Jul. 8, 2004

(65) Prior Publication Data

US 2005/0013084 A1 Jan. 20, 2005

(30) Foreign Application Priority Data

Jul. 14, 2003 (DE) ..... 103 31 866

(51) Int. Cl.
*H01H 47/00* (2006.01)

(52) U.S. Cl. ..... 361/139

(58) Field of Classification Search ..... 361/139
See application file for complete search history.

(56) References Cited

U.S. PATENT DOCUMENTS 5,034,873 A 7/1991 Feldtkeller ..... 363/21.05
5,157,592 A * 10/1992 Walters ..... 363/17
5,184,289 A 2/1993 Bonnet et al. ..... 363/20
5,729,443 A * 3/1998 Pavlin ..... 363/21.12
6,129,073 A 10/2000 Yamakado et al. ..... 123/490
6,211,749 B1 4/2001 Yuzurihara et al. ..... 333/17.3
6,317,021 B1 * 11/2001 Jansen ..... 336/155
2004/0119577 A1 6/2004 Weger ..... 336/229

* cited by examiner

*Primary Examiner*—Michael J Sherry
*Assistant Examiner*—Luis Roman
(74) *Attorney, Agent, or Firm*—Duane Morris LLP

(57) ABSTRACT

The invention relates to a special control for current-controlled inductors which allows inductance to be varied at a considerably faster rate than is the case in the prior art. The control presented in the invention can be employed for coil arrangements which carry at least one control winding and at least two working windings on a ferro or ferromagnetic core material. The accelerated change in inductance is achieved by means of a demagnetizing inverse voltage impulse which is generated by a special part of the circuit.

14 Claims, 2 Drawing Sheets

MEANS FOR CONTROLLING A COIL ARRANGEMENT WITH ELECTRICALLY VARIABLE INDUCTANCE

This application claims the filing date priority of German Patent Application No. 103 31 866.6 filed Jul. 14, 2003, the specification of which is incorporated herein in its entirety.

FIELD OF THE INVENTION

The invention relates to a means for controlling a coil arrangement with electrically variable inductance and a coil device comprising such a coil arrangement with variable inductance which can be controlled by means of a current.

BACKGROUND OF THE INVENTION

The invention especially relates to a means for controlling a coil arrangement with variable inductance which allows the inductance to be varied at particularly rapid rates. This means can then be used whenever the inductance of the coil arrangement is varied by means of current-induced pre-magnetization and when at least two working windings are provided which are connected in parallel.

The invention can basically be employed in all applications in which current-controlled, variable inductors are needed to control an electric alternating current. More specifically, the invention can be applied to current-controlled, variable inductors having a control winding and two working windings connected in parallel as shown, for example, in FIG. 2.

Coil arrangements with variable inductance are used in power engineering and telecommunications applications. One invention-related application of coils with variable inductance is in the area of switching power supplies in order to adapt the energy taking place in the high-frequency range to changing load requirements.

Examples of such switching power supplies are described in "High Power Densities at High Power Levels" by A. Jansen et al. in CIPS 2002, $2^{nd}$ International Conference on Integrated Power Systems, 11-12 Jun. 2002, Bremen, Germany and in German Patent Application 103 21 234.5, to which reference is made.

To realize such electrically controlled inductance, the effect in which the relative magnetic permeability of ferro and ferromagnetic materials decreases together with the magnetic flux density in the material can be exploited. Based on this principle, numerous coil arrangements have been proposed in the past which, by means of a current in a control coil, cause a magnetically highly permeable coil core to be pre-magnetized and in this way control the inductance of the inductor winding, also positioned on the coil core.

U.S. Pat. No. 6,317,021 proposes that two inductor windings be connected in parallel in such a way that the magnetic fluxes for the control winding generated by these windings cancel each other out.

German Patent Application 102 60 246.8 proposes a coil arrangement with variable inductance having two separate toroid coils which carry inductor windings, as well as a control winding which encompasses the two wound toroid coils in order to pre-magnetize the core material of the toroid coils.

The invention can particularly be applied to current-controlled, variable inductors which have inductor windings connected in parallel as outlined above in reference to U.S. Pat. No. 6,317,021. In the following description, the term inductance thus refers to the inductor or working windings, and particularly to the working windings connected in parallel, of such a coil.

In such coil arrangements, a direct current in the control winding brings about DC pre-magnetization of the entire core material and thus changes the inductance of the working windings. It is clear that the direction of the direct current for pre-magnetization is arbitrary.

The main disadvantage of these current-controlled, variable inductors is the relatively long demagnetization time of the core material resulting in a slow change in inductance from lower to higher inductance. If the variable inductor is used, for example, as an AC power valve in the secondary regulation loop of a switching power supply, this sluggishness results in considerable overshoot once load jumps that go from a high load to a low load appear. This voltage overshoot is countered in the prior art by clamping circuits. These clamping circuits, however, expose a large number of components to high stress due to short-circuit currents.

In the past, the problem thus arose that the current-controlled, variable inductors of the type described could only run through inductance variations very slowly, that is they could only vary their inductance from a minimum value to a maximum value within several milliseconds.

It is therefore the object of the invention to accelerate this process of inductance variation and accordingly to make damper circuits superfluous and to prevent the high component stress associated with them.

SUMMARY OF THE INVENTION

This object has been achieved by a means for controlling a coil arrangement in accordance with claim 1 as well as a method of controlling a coil arrangement in accordance with claim 9. The invention also provides a coil device in accordance with claim 7 and a switching power supply, which uses such a coil arrangement, in accordance with claim 8.

Summarized in brief, the invention relates to a special control for current-controlled inductors that enables a considerably more rapid change in inductance than is the case in the prior art. The control presented in the invention can be used in coil arrangements that carry at least one control winding and at least two inductor or working windings on a ferro or ferromagnetic core material. The accelerated change in inductance is achieved by means of a demagnetizing inverse voltage pulse which is generated by a special part of the circuit. The term "working winding" refers to those windings which form the inductor to be controlled.

According to the invention, a circuit is provided that delivers a control current to the control winding in order to vary the inductance of the coil arrangement. A demagnetization circuit is additionally provided which generates an inverse voltage pulse and applies it to the control winding in order to accelerate the change and particularly the increase in the inductance of the coil arrangement. An inverse voltage pulse is an pulse whose sign is inverse to the sign of the control current. If, for example, the control current is positive in a defined direction then the voltage pulse in this defined direction is negative, and vice versa. Thus mention is made below of a negative voltage pulse. By applying a voltage pulse with inverse polarity (with respect to the control current) the iron core of the coil arrangement is demagnetized at a higher absolute voltage value. Since the demagnetization time is inversely proportional to the absolute value of the voltage pulse, theoretically the turn-off time may be made as short as desired. The duration and absolute value of the inverse voltage pulse is, however, critical inasmuch as an pulse that is too short would not fully complete the turn-off process whereas an pulse that is too long would trigger undesired reactivation.

Thus in accordance with the invention, the duration and/or the absolute value of the voltage pulse is adjustable. In particular the duration and/or the voltage pulse are adjusted as a function of the control current which is delivered to the control winding immediately before the inverse voltage was applied. The correct pulse duration can thus be derived through continuous monitoring of the control current that was applied to the variable inductance, the duration or the width of the inverse voltage pulse being determined by the momentary current level. In some applications, however, a fixed pulse width may also be desirable.

The invention is based on the following considerations and findings. In the coil arrangement concerned, having two working windings connected in parallel, the working windings act like two induction coils connected in parallel since the magnetic field of one working winding does not penetrate the other working winding. The magnetic flux of each induction coil (working winding) passes through the control winding. However, the magnetic fluxes penetrate the control winding in opposite directions. Since both working windings have the same number of windings and are supplied with the same voltage, the absolute value of the magnetic flux is the same so that the net magnetic flux in the control winding is zero. This means that the control winding is electrically neutral for electrical signals applied to the working windings, that is they are not electrically interactive. On the other hand, the working windings connected in parallel act as a short-circuited secondary winding for every AC signal to the control winding.

FIG. 1 shows an equivalent circuit diagram for the current-controlled, variable inductor that serves to explain the parameters which are relevant for turn-on and turn-off speed. In FIG. 1, $R_p$ is the resistance of the control winding and $R_s$ the series resistance of the two working windings (or secondary windings), which is equal to four times the measured value of the working windings connected in parallel. The symbol n is the winding ratio of the control winding to a working winding. $L_c$ is the control winding inductor. When the switch S is closed, the equation for the increase in magnetization current is as follows:

$$i_L(t) = \frac{V_C}{Rp} \cdot \left(1 - \left(1 - \frac{i_L(0) \cdot Rp}{Vc}\right) \cdot e^{\frac{Rp \cdot n^2 \cdot Rs}{(Rp + n^2 \cdot Rs) \cdot Lc} \cdot t}\right) \tag{1}$$

Of particular interest here is the rate of change of the current since this also defines the rate of change of the magnetic field:

$$\frac{d i_L}{d t}(t) = \frac{Vc}{Lc} \cdot \frac{n^2 \cdot Rs}{Rp + n^2 \cdot Rs} \cdot \left(I - \frac{i_L(0) \cdot Rp}{Vc}\right) \cdot e^{\frac{Rp \cdot n^2 \cdot Rs}{(Rp + n^2 \cdot Rs) \cdot Lc} \cdot t} \tag{2}$$

The technician will recognize that lower values for $R_s$ slow down the turn-on process, that is the change in inductance from the maximum value to the minimum value. With regard to high efficiency, $R_s$ should, on the other hand, be small. Thus to accelerate the turn-on process, either $R_p$ can be reduced or $V_c$ increased. The first mentioned strategy is effective as soon as $R_p$ is less than $n^2R_s$. The most effective means of accelerating the turn-on speed, however, is by increasing $V_c$.

During turn-off, the switch S normally remains open (or high ohmic). The magnetic field decreases with the same speed as the current through $n^2R_s$ decreases:

$$i_L = i_L(0 \cdot e^{\frac{n^2 \cdot Rs}{Lc} \cdot t} \ldots \frac{d i_L}{d t} = -i_L(0) \cdot \frac{n^2 \cdot Rs}{Lc} \cdot e^{\frac{n^2 \cdot Rs}{Lc} \cdot t} \tag{3}$$

The technician will be aware that the speed or rate of change is small because $R_s$ has to be kept small when efficiency is taken into consideration.

Equation (2) opens up another possibility for rapid turn-off (increase in inductance) which is used in the invention. By applying a negative voltage $V_c$, demagnetization of the variable inductor can be enforced at practically-any desired speed. In practice, it is important to interrupt the inverse voltage pulse as soon as the magnetizing current $i_L$ is zero.

From these findings, an optimal duration for the inverse voltage pulse can be derived in practice by solving equation (1) for t with $i_L$ (t)=0:

$$t = \frac{(Rp + n^2 \cdot Rs) \cdot Lc}{Rp \cdot n^2 \cdot Rs} \cdot 1n\left(1 - \frac{i_L(0) \cdot Rp}{Vc}\right) \tag{4}$$

In equation (4) it is important to note that $V_c$ represents a negative value since it is formed by an inverse voltage pulse. In practice, the correct duration for the inverse voltage pulse can be derived by continuously monitoring the control current of the variable inductance and by recording the control current immediately before the inverse voltage pulse is triggered.

BRIEF DESCRIPTION OF THE DRAWINGS

Further characteristics and advantages of the invention can be found in the following detailed description of preferred embodiments with reference to the drawings. The figures show.

DETAILED DESCRIPTION OF PREFERRED EMBODIMENTS

Figure 1:
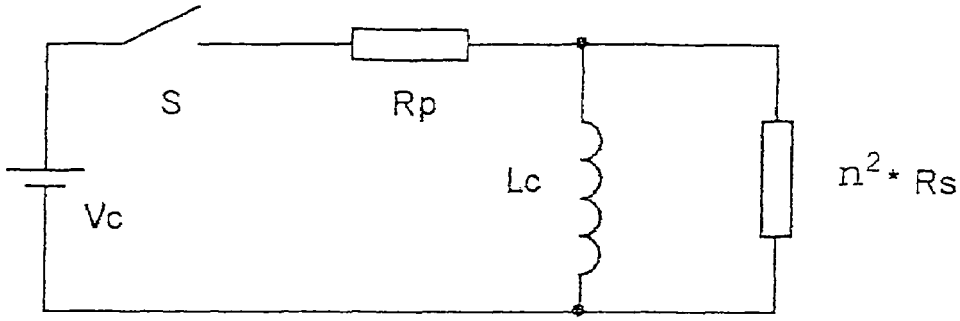
FIG. 1 an equivalent circuit diagram of a current-controlled, variable inductor in accordance with the prior art.
Figure 2:
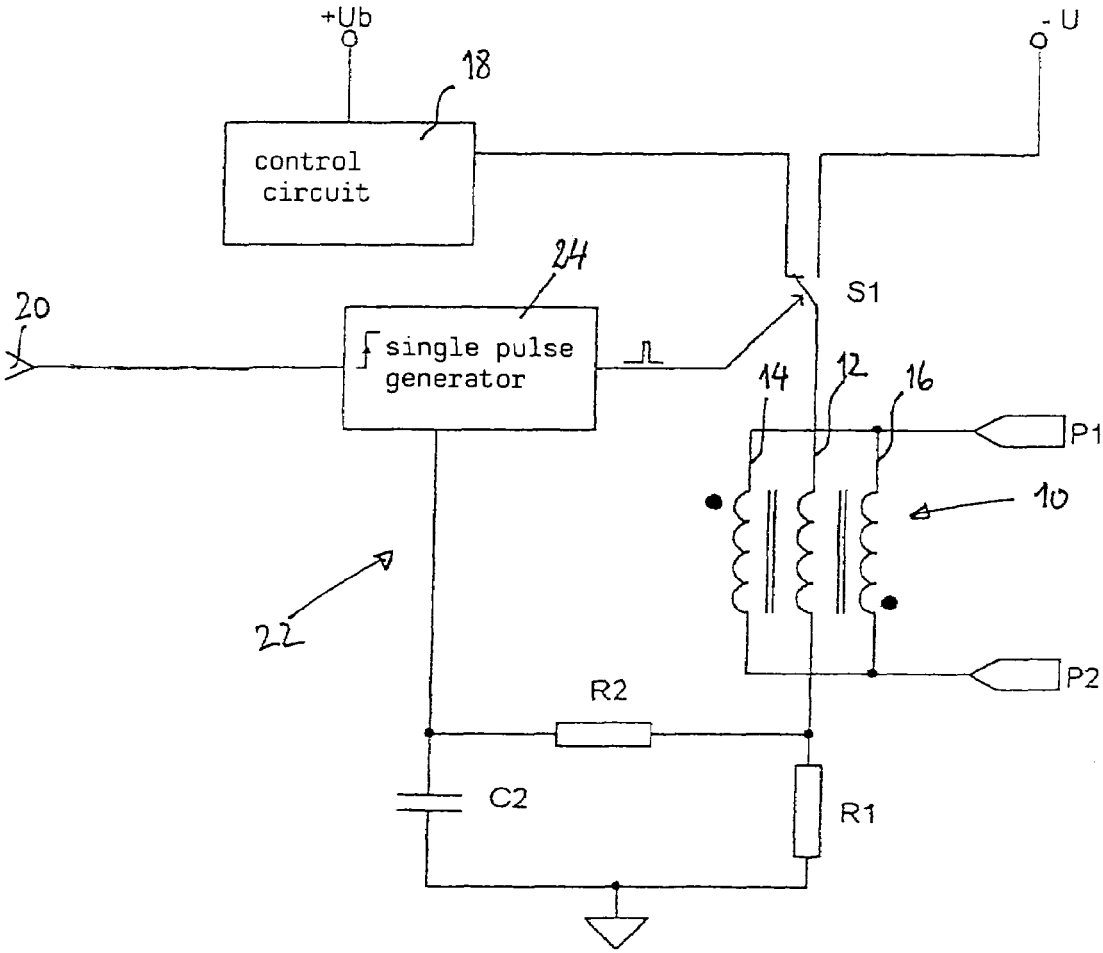
FIG. 2 a circuit diagram for a means for controlling a coil arrangement in accordance with a first embodiment of the invention.

FIG. 2 shows an example of a circuit to control a coil arrangement with variable inductance in accordance with the invention. The coil arrangement in general is indicated by 10 in FIG. 2 and comprises a control winding 12 and two working windings 14, 16 connected in parallel. During normal operation, the coil arrangement 10 is controlled using a conventional control circuit 18. The control circuit 18 is connected to the coil arrangement 10 via a switch S1. In practice, the coil arrangement 10, for example, can be integrated together with the control circuit 18 in the secondary regulation loop of a switching power supply.

When the circuit in FIG. 2 receives a signal at an input 20 that calls for a rapid turn-off of inductance, (i.e. a rapid increase of inductance), a demagnetization circuit is activated which is indicated in general by 22 in FIG. 2. Rapid turn-off of the variable inductance could be necessary, for example, if the threat of a strong voltage overshoot during switching processes is identified.

The demagnetization circuit 22 comprises a single pulse generator 24, which, for example, can take the form of a monoflop. The output signal of the single pulse generator 24 is a single pulse which switches the switch S1 thus separating the control winding 12 from the control circuit 18 and connecting it to a negative voltage −U. The negative voltage −U is applied to the control winding 12 for the duration of the single pulse in order to accelerate the demagnetization of the core material of the coil arrangement.

In accordance with the invention, the duration of this control pulse is preferably derived as a function of the absolute value of the control current that had been applied to the control winding 12 immediately before switching. This control current is recorded via the resistor R1 and transferred to the single pulse generator 24 so that the single pulse generator 24 sets the pulse length.

The resistor shown in FIG. 2 and the capacitor C2 act as a high-frequency notch filter. The working connections of the working windings 14 and 16 are indicated by P1 and P2.

Figure 3:
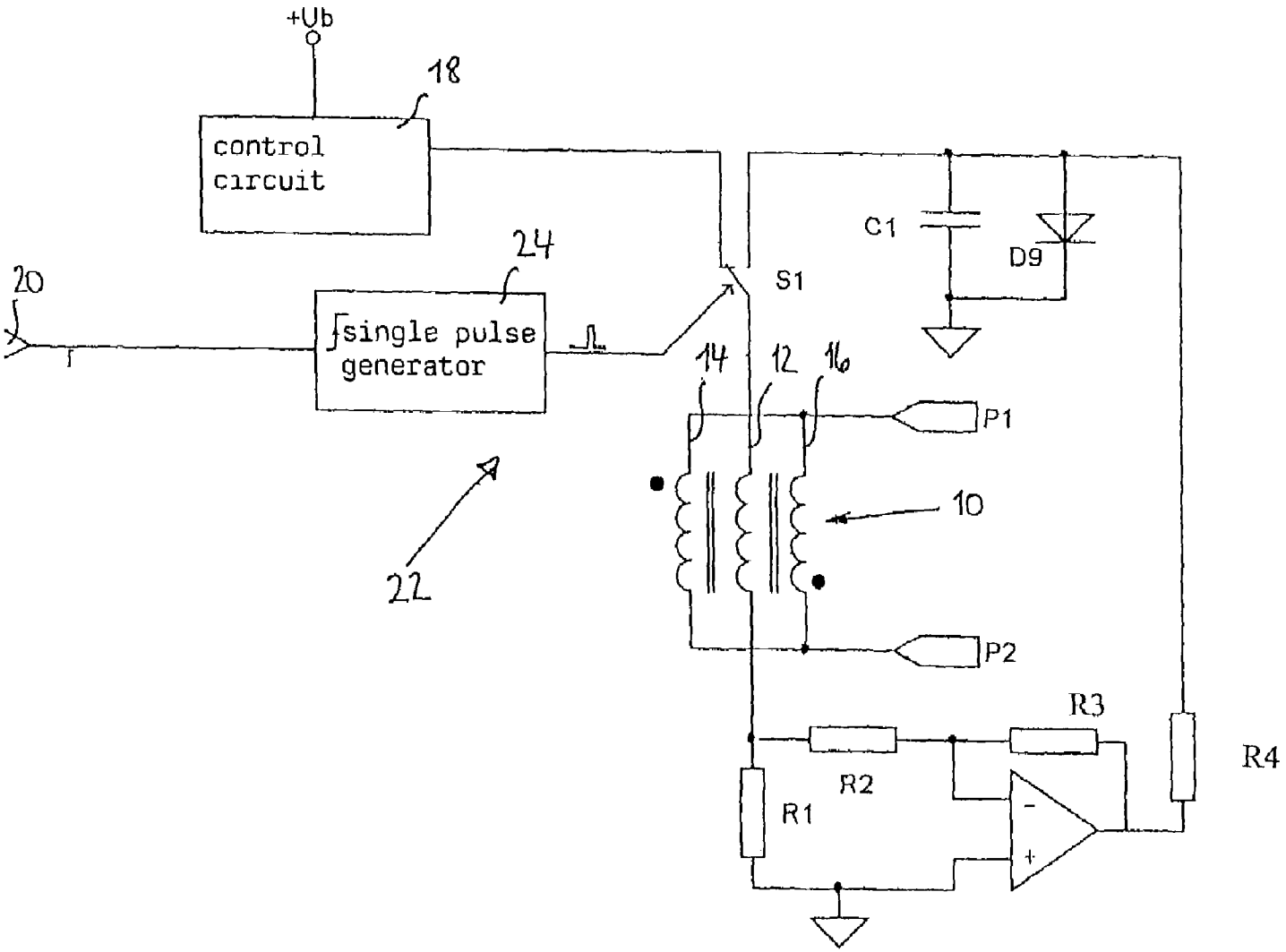
FIG. 3 a circuit diagram for a means for controlling a coil arrangement in accordance with a second embodiment of the invention.

FIG. 3 shows a circuit diagram of the means for controlling a coil arrangement with variable inductance in accordance with an alternative embodiment of the invention. Components corresponding to those in FIG. 2 are indicated with the same reference numbers and not described again.

In the embodiment shown in FIG. 3, the pulse width of the inverse voltage pulse set by the single pulse generator 24 is predetermined. This means that the coil arrangement 10 is connected via the switch S1 to the negative voltage −U for a fixed predetermined duration. However, in this embodiment, the absolute value of the negative voltage is determined as a function of the control current in the control winding 12 immediately before the inverse voltage pulse is applied. For this purpose, the capacitor C1 is charged to a voltage that is proportional to the control current that flows through the control winding 12 of the coil arrangement. Consequently, the inverse voltage pulse or demagnetization pulse will have a higher absolute value when the pre-magnetization of the coil arrangement is stronger. The diode D9 prevents reverse charging of the capacitor C1. The current flowing through the control winding 12 is recorded via the resistor R1.

The features revealed in the above description, the claims and the figures can be important for the realization of the invention in its various embodiments both individually and in any combination whatsoever.

IDENTIFICATION REFERENCE LIST

10 coil arrangement
12 control winding
14, 16 working windings
18 control circuit
20 input
22 demagnetization circuit
24 single impulse generator
$R_p$, $R_s$ resistors
Lc inductor
S, S1 switch
R1, R2, R3, R4 resistors
C1, C2 capacitors
P1, P2 connections
n ratio of number of windings (control winding to each working winding)
n2*Rs transformed total primary (control winding side) resistance (series resistance) of the two working windings

The invention claimed is:

1. A device for controlling a coil arrangement (10) with electrically variable inductance, the coil arrangement (10) having at least one control winding (12) and two working windings (14, 16) connected in parallel which are placed on a core material, said device comprising: a control circuit (18) which delivers a control current to the control winding (12) in order to vary the inductance of the coil arrangement (10), and a demagnetization circuit (22) which generates an inverse voltage pulse and applies it to the control winding (12) in order to accelerate the change in inductance of the coil arrangement (10); wherein the demagnetization circuit (22) includes a single-pulse generator (24) connected to the control winding (12) through a control switch (S1) and wherein the duration of a pulse from the single-pulse generator is a function of the absolute value of the control current applied to the control winding immediately before switching the control switch.

2. The device according to claim 1, wherein the demagnetization circuit (22) includes a resistor (R1) which records the control current before the inverse voltage pulse is applied to the control winding (12).

3. The device according to claim 2, wherein resistors (R2, R3) are used to adjust the voltage pulse by adjusting the absolute value of the pulse as a function of the control current.

4. The device according to claim 1 wherein the electronic switch (S1) separates the control circuit (18) from the coil arrangement (10) when the voltage pulse is being applied.

5. A device for controlling a coil arrangement (10) with electrically variable inductance, the coil arrangement (10) having at least one control winding (12) and two working windings (14, 16) connected in parallel which are placed on a core material, said device comprising: a control circuit (18) which delivers a control current to the control winding (12) in order to vary the inductance of the coil arrangement (10), and a demagnetization circuit (22) which generates an inverse voltage pulse and applies it to the control winding (12) in order to accelerate the change in inductance of the coil arrangement (10); wherein the demagnetization circuit (22) includes a single-pulse generator (24) connected to the control winding (12) through a control switch (S1) wherein the absolute value of the inverse voltage pulse is a function of the control current in the control winding immediately before the inverse voltage pulse is applied to the control winding.

6. A device for controlling a coil arrangement (10) with variable current-controlled inductance which has a least one control winding (12) and two working windings (14, 16) connected in parallel which are placed on a core material and, a demagnetization circuit which includes a single-pulse generator (24) connected to the control winding (12) through a control switch (S1), the device comprising:

a means for controlling the coil arrangement which delivers a control current to the control winding (12) in order to vary the inductance of the coil arrangement (10) and which generates an inverse voltage pulse and applies it to the control winding (12) in order to accelerate the change in inductance of the coil arrangement (10), wherein the duration of said inverse voltage pulse from said means for controlling is a function of the absolute value of the control current applied to the control winding immediately before switching the control switch.

7. The device according to claim 6, wherein the demagnetization circuit (22) has means of recording the control current before the inverse voltage pulse is applied to the control winding (12).

8. The device according to claim 6, wherein the device has further means of separating the control circuit (18) from the coil arrangement (10) when the inverse voltage pulse is being applied.

9. The device of claim 6, further comprising:

a switching power supply having a primary input switching stage and at least one secondary output channel, the output channel having a secondary regulation loop with a coil means (10).

10. A device for controlling a coil arrangement (10) with variable current-controlled inductance which has a least one control winding (12) and two working windings (14, 16) connected in parallel which are placed on a core material and, a demagnetization circuit which includes a single-pulse generator (24) connected to the control winding (12) through a control switch (S1), the device comprising:

a means for controlling the coil arrangement which delivers a control current to the control winding (12) in order to vary the inductance of the coil arrangement (10) and which generates an inverse voltage pulse and applies it to the control winding (12) in order to accelerate the change in inductance of the coil arrangement (10), the absolute value of the inverse voltage pulse can is a function of the control current in the control winding immediately before the inverse voltage pulse is applied to the control winding.

11. A method of controlling a coil arrangement (10) with variable inductance, the coil arrangement (10) having at least one control winding (12) and working windings (14, 16) which are placed on a core material, the method comprising:

delivering a control current to the control winding (12) to change the inductance of the coil arrangement (10), and generating an inverse voltage pulse by a single pulse generator (24); and applying the inverse voltage pulse to the control winding (12) through a switch (S1) to accelerate the change in an inductance of the coil arrangement (10), wherein the duration and absolute value of the voltage pulse is a function of the control current before the voltage pulse is applied.

12. A method according to claim 11, wherein the control current is blocked whilst the voltage pulse is being applied.

13. A device for controlling a coil arrangement with electrically variable inductance, the coil arrangement having at least one control winding and two working windings connected in parallel which are placed on a core material, said device comprising: a control circuit that delivers a control current to the control winding in order to vary the inductance of the coil arrangement; and a demagnetization circuit that generates an inverse voltage pulse and applies it to the control winding in order to accelerate the change in inductance of the coil arrangement, wherein the demagnetization circuit includes a single-pulse generator connected to the control winding through a control switch and wherein said inverse voltage pulse is not provided by a voltage clamp and wherein the duration of a pulse from the single-pulse generator is a function of the absolute value of the control current applied to the control winding immediately before switching the control switch.

14. A device for controlling a coil arrangement with electrically variable inductance, the coil arrangement having at least one control winding and two working windings connected in parallel which are placed on a core material, said device comprising: a control circuit that delivers a control current to the control winding in order to vary the inductance of the coil arrangement; and a demagnetization circuit that generates an inverse voltage pulse and applies it to the control winding in order to accelerate the change in inductance of the coil arrangement, wherein the demagnetization circuit includes a single-pulse generator connected to the control winding through a control switch and wherein the absolute value of the inverse voltage pulse is a function of the control current in the control winding immediately before the inverse voltage pulse is applied to the control winding.

* * * * *